United States Patent [19]

Buecher

[11] Patent Number: 4,658,745

[45] Date of Patent: Apr. 21, 1987

[54] COLLAPSIBLE SALVAGE DRUM AND METHOD

[75] Inventor: Roger W. Buecher, Kaneohe, Hi.

[73] Assignee: The United States of America as represented by the Secretary of the Navy, Washington, D.C.

[21] Appl. No.: 276,099

[22] Filed: Jun. 22, 1981

[51] Int. Cl.[4] ..... B63C 7/10

[52] U.S. Cl. ..... 114/54; 114/50

[58] Field of Search ..... 114/50, 52, 53, 54; 441/28, 29

[56] References Cited

U.S. PATENT DOCUMENTS

| | | | |
|---|---|---|---|
| 2,413,313 | 12/1946 | Cook | 114/54 |
| 2,451,002 | 10/1948 | Sturtevant | 114/54 |
| 2,635,574 | 4/1953 | Sturtevant | 114/54 |
| 2,887,080 | 5/1959 | Fedrowich | 114/54 |
| 2,938,489 | 5/1960 | Cunningham | 114/54 |
| 3,162,165 | 12/1964 | Brien | 114/54 |
| 3,282,238 | 11/1966 | Tucker | 114/52 |
| 3,322,088 | 5/1967 | Harada et al. | 114/54 |
| 3,500,785 | 3/1970 | Strange | 114/50 |
| 3,512,493 | 5/1970 | Hallanger | 114/53 |
| 3,659,299 | 5/1972 | Davidson et al. | 9/8 R |
| 3,710,746 | 1/1973 | McDonald | 114/52 |
| 3,732,837 | 5/1973 | Hogan | 114/52 |
| 4,078,509 | 3/1978 | Buecher et al. | 114/54 |

*Primary Examiner*—Joseph F. Peters, Jr.
*Assistant Examiner*—Thomas J. Brahan
*Attorney, Agent, or Firm*—Ervin F. Johnston

[57] ABSTRACT

A salvage apparatus is provided which includes a bellows type drum container. The container includes a flexible skirt which is generally tubular with top and bottom ends. The container further includes a pair of rigid plates, one of the plates being sealably mounted to the top of the skirt and the other plate being sealably being mounted to the bottom of the skirt. It is important that the lateral area of each plate substantially encompass the lateral expanded area of the respective skirt end. A plurality of controllable valves are provided for selectively opening and closing the passage of fluid. One of these valves is located in the bottom plate for selectively allowing the passage of water into or out of the container and another valve is located through the container for selectively introducing pressurized air into the container. A relief valve is also located through the container for relieving air from the container when the inside and outside differential pressure has exceeded a predetermined level.

6 Claims, 15 Drawing Figures

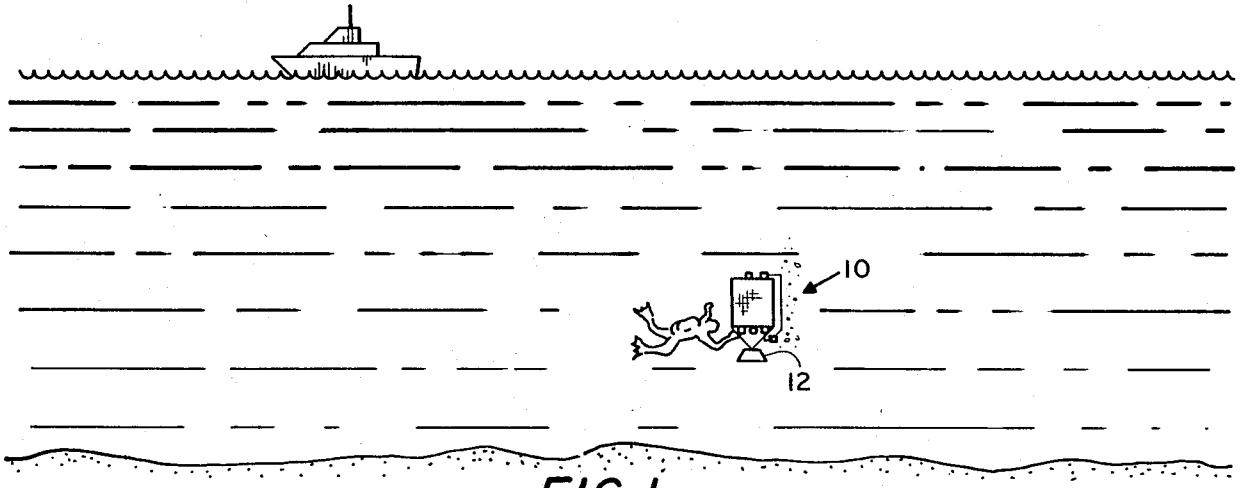
FIG. 1
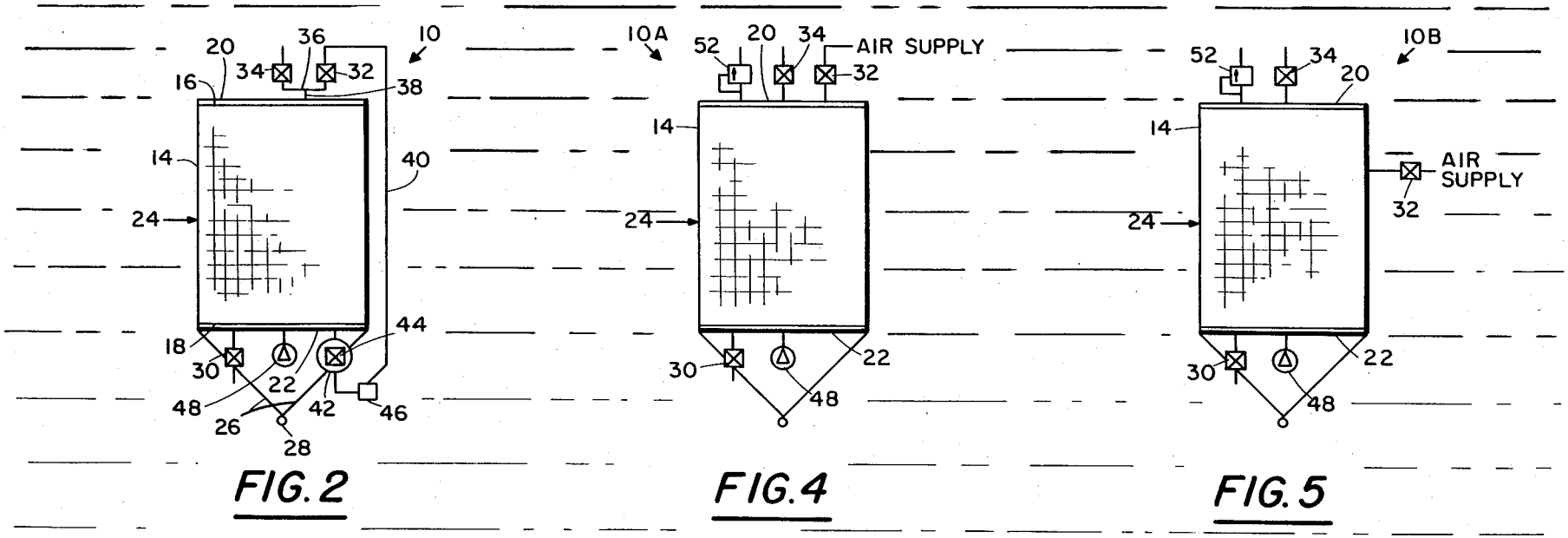
FIG. 2
FIG. 4
FIG. 5

VALVE 32
SHUTS OFF AIR SUPPLY
VALVE 34
LETS AIR OUT
STAND PIPE 40
ACTS AS RELIEF VALVE
SCUBA BOTTLE 42
CONTAINS AIR SUPPLY
SCUBA REGULATOR 46
MAINTAINS BAG PRESSURE
VALVE 30
LETS WATER INTO
OR OUT OF BAG
WATER
PUMP 48
PUMPS WATER
INTO BAG
FIG.6a ATTACHMENT.
FIG.6b EXPAND CONTAINER.
FIG.6c EXPAND CONTAINER.
FIG.6d PRESSURE CONTAINER.

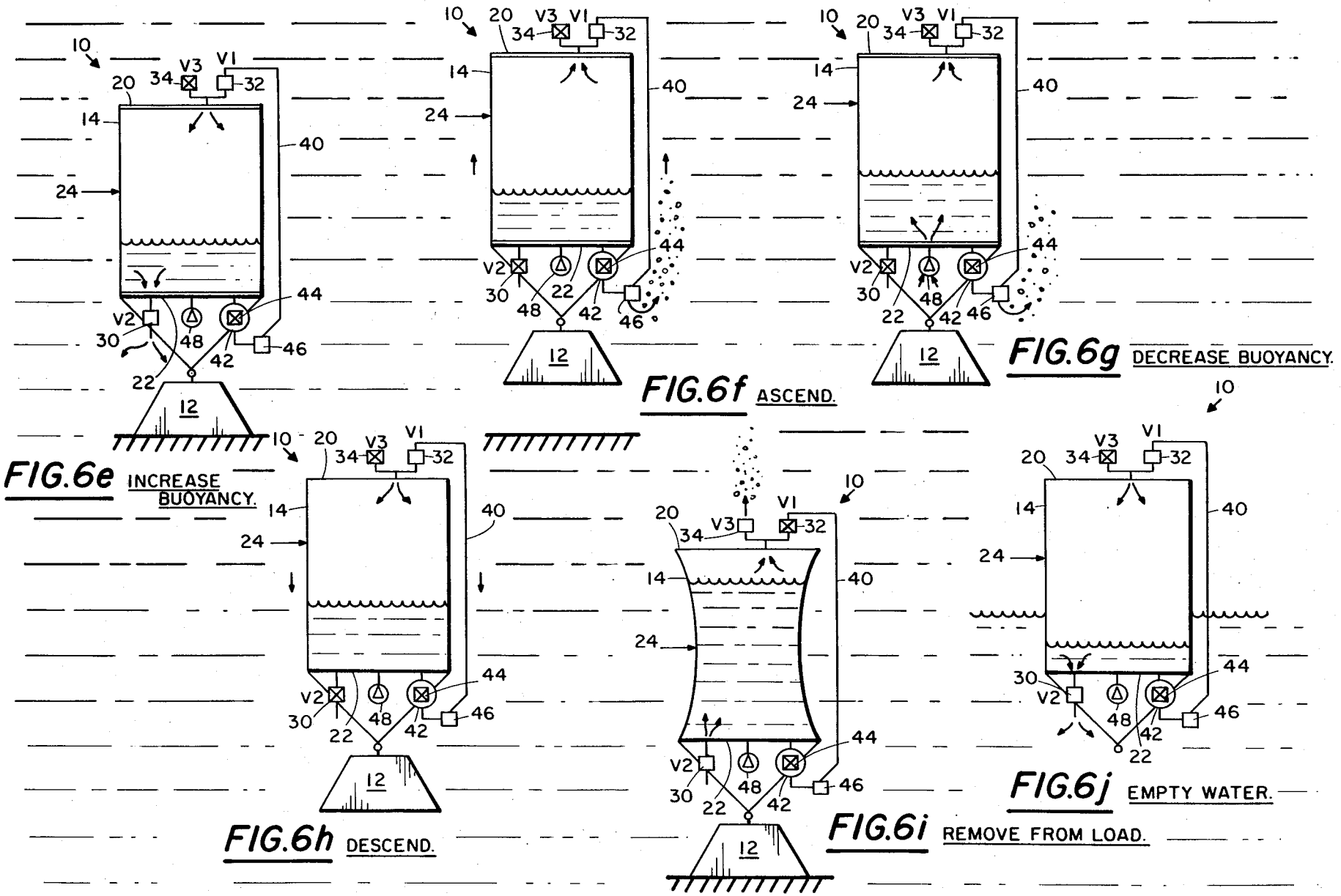
FIG.6e INCREASE BUOYANCY.
FIG.6f ASCEND.
FIG.6g DECREASE BUOYANCY.
FIG.6h DESCEND.
FIG.6i REMOVE FROM LOAD.
FIG.6j EMPTY WATER.

COLLAPSIBLE SALVAGE DRUM AND METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy has been increasingly involved in salvage operations. These operations include the recovery of practice torpedoes, various hardware placed on the ocean bottom and objects which are inadvertently dropped. The Navy has a continuing program to improve its capability and equipments for recovering submerged objects. The requirements for salvage operations at deep ocean depths have become more frequent, consequently requiring an advance in the state of the art of the equipment.

Salvage operations generally utilize lifting lines and/or buoyant lift structures. The use of buoyant lift structures, either rigid or collapsible, requires placement, attachment, and deballasting or inflation of the buoyant structure.

The primary problem in using buoyant recovery systems is controlling the ascent velocity once the lift has begun. This is particularly true with collapsible lift bags. If the load to be lifted is less than the bag capacity, ascent will begin before the bag has reached its maximum displacement. If the bag is closed, it will normally have folds which decrease its volume below the fully inflated volume, and if it is open, the bag will normally have both folds and water inside. In either case, as the bag ascends, the gas expands forcing out the water and/or the folds, thereby increasing the net buoyancy of the bag. As the buoyancy increases, the ascent velocity increases which can result in a very hazardous uncontrolled ascent of the object to be salvaged. Further, during a rapid ascent, a velocity head will develop at a stagnation point at the top of the bag. When this velocity head exceeds the internal pressure opposite the stagnation point the top of the bag will deform. This leads to an unstable bubble geometry at the top of the bag and will normally result in substantial horizontal excursions of the lifting bag.

Collapsible bags are often preferred to rigid pontoon type lifting devices because collapsible bags can be easily stored and transported when not in use. However, the harardous ascent velocities of the collapsible bags have been a deterrence. A solution to the hazardous ascent velocity problem is found in U.S. Pat. No. 4,078,509 to Buecher and Hoffman. In that patent a water line was utilized for completely filling a collapsible bag with water until the bag was expanded to its full form with water only. The bag was then deballasted as required for lift purposes. A collapsible bag according to the teachings of the patent has been built and successfully utilized by the Navy without any problem in the ascent velocity. However, the requirement of the water line has been found to be cumbersome and awkward. It is the problems associated with the water line that the present invention has overcome. Accordingly, the present invention is an improvement over the collapsible bag set forth in U.S. Pat. No. 4,078,509.

SUMMARY OF THE INVENTION

The present invention is a salvage apparatus which includes a bellows type drum or container. The container includes a flexible skirt which is generally tubular with top and bottom ends. The container further includes a pair of rigid plates, one of the plates being sealably mounted to the top end of the skirt and the other plate being sealably mounted to the bottom end of the skirt. It is important that the lateral area of each plate substantially encompass the lateral expanded area of the respective skirt end. A plurality of controllable valves are provided for selectively opening and closing the passage of fluid. One of these valves is located in the bottom plate for selectively allowing the passage of water into or out of the container, and another one of these valves is located in the container for selectively introducing pressurized air into the container. A relief valve is also located through the container for relieving air from the container when the inside and outside differential pressure has exceeded a predetermined level. With this arrangement the water line required for the collapsible bag of U.S. Pat. No. 4,078,509 has been eliminated. Further, the salvage apparatus of the present invention is easier to store and to operate. The present invention is especially useful when making lifts less than 500 pounds from small boats.

OBJECTS OF THE INVENTION

An object of the present invention is to provide a lift bag salvage apparatus which has a unique improvement for eliminating the need of a water line in U.S. Pat. No. 4,078,509.

Another object is to provide a lift bag salvage apparatus which can be utilized to lift a submerged object in a controlled ascent without the requirement of a water line and pump combination.

A further object is to provide a controlled buoyancy lift apparatus which can be easily operated by a diver for making small lifts, that is less than 500 pounds.

Yet another object is to provide a buoyancy lift bag apparatus which can be easily stored, descended in the water in a compact condition, expanded by a pressurized air source, and intutively controlled for ascent or descent of an operational load.

Other objects and many of the attendant advantages of this invention will be readily appreciated as the same becomes better understood by reference to the following detailed description when considered in connection with the accompanying drawings.

BRIEF DESCRIPTION OF THE DRAWINGS

FIG. 1 illustrates an ocean elevation view of the present invention being utilized by a diver to raise an object from the ocean floor.

FIG. 2 is a schematic elevation view of a preferred embodiment of the invention.

FIG. 4 is a schematic elevation view of another embodiment of the invention.

FIG. 5 is a schematic elevation of still another embodiment of the invention.

FIG. 6*a* through FIG. 6*j* are schematic elevation view of the preferred embodiment of the invention in its various steps of operation.

DESCRIPTION OF THE PREFERRED EMBODIMENTS

Figure 3:
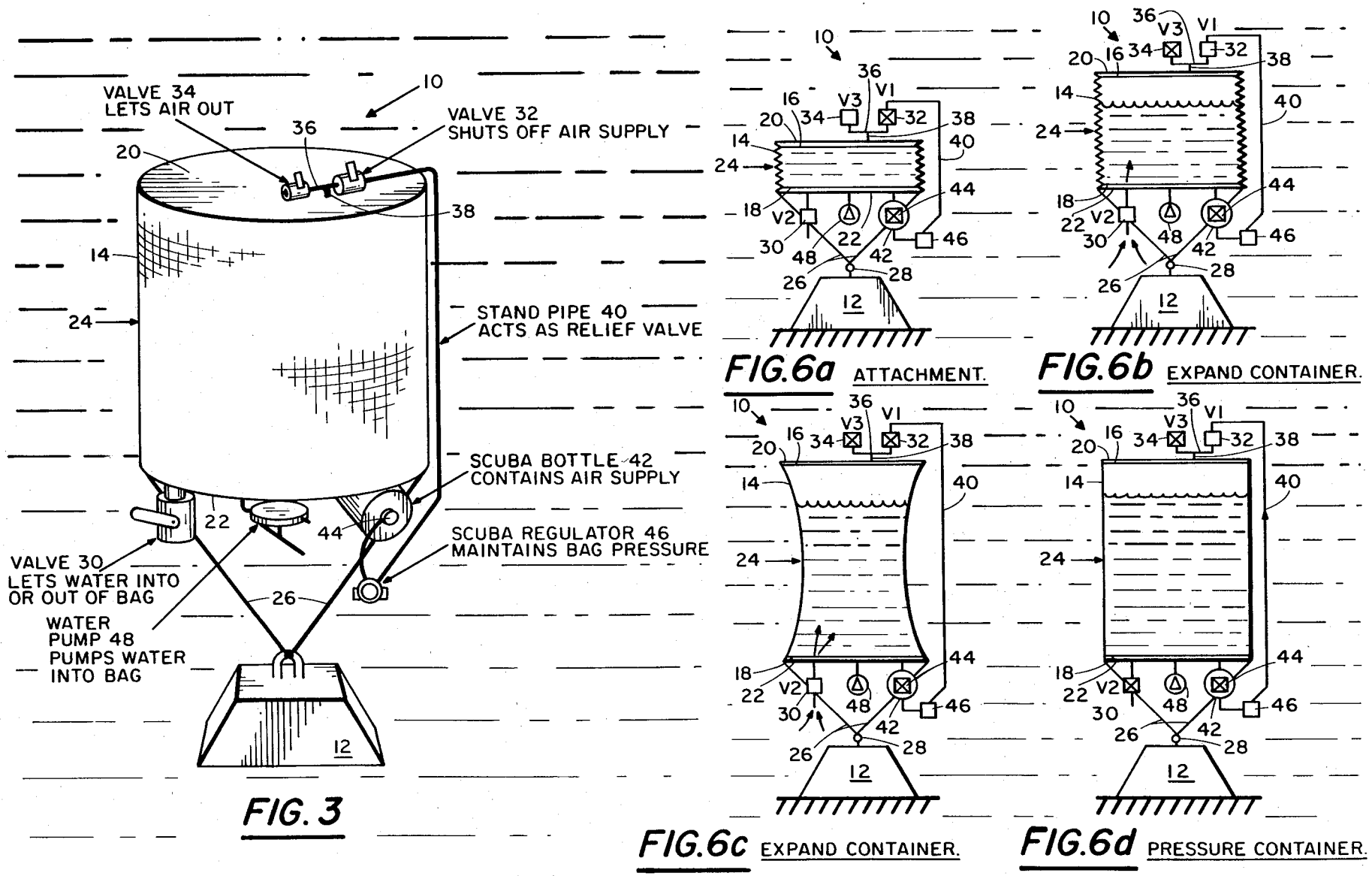
FIG. 3 is a schematic isometric view of the preferred embodiment of the invention.

Referring now to the drawings wherein like reference numerals designate like or similar parts throughout the several views there is illustrated in FIG. 1*a* diver who is operating the preferred salvage apparatus 10 for lifting an object 12 from the bottom of the ocean. The preferred salvage apparatus is illustrated in FIGS. 2 and 3. As illustrated in these FIGS. the salvage apparatus includes a flexible skirt 14 which is generally tubular in its expanded condition with top and bottom ends 16 and 18 respectively. A pair of rigid plates are provided, one of the plates 20 being sealably mounted to the top end 16 of the skirt and another plate 22 being sealably mounted to the bottom end 18 of the skirt.

The very essence of the invention is that the lateral area of each plate must substantially encompass the lateral expanded area of each respective skirt end 16 and 18 in its expanded condition. This relationship is illustrated in FIGS. 2 and 3 and results in a bellows type expandable form of container 24. With this arrangement the skirt 14 is expanded to a smooth configuration without any folds when the plates 16 and 18 are separated to their maximum extent. If the plates 16 and 18 were each larger in lateral area than the lateral area of the respective skirt end the result would be the same, however, if the area of either plate was less than the area of the respective skirt end the skirt would have a folded configuration when the plates 20 and 22 were separated to their maximum extent. While it is not absolutely essential it is preferred that the plates 20 and 22 be circular and that the skirt 14 by cylindrically shaped so that its expanded ends 16 and 18 are likewise circular. The features resulting from the aforementioned arrangement will become more readily apparent and appreciated in the description hereinbelow. Connected to and extending downwardly from the bottom end of plate 22 there may be provided lift lines 26 which are joined at a lifting eye 28 for attachment to object 12.

The collapsible salvage apparatus 10 also includes a plurality of controllable valve means for selectively opening and closing the passage of fluid with respect to the bellows type container 24. These valve means may be provided with handles for hand operation to open and close the passage of the fluid. A first valve 30 is located in the bottom plate 22 for selectively allowing the passage of water into or out of the bellows type container 24. A second valve 32 is located through the container 24 for selectively introducing pressurized air into the container. In order to increase a the capability of the lift apparatus a third valve 34 may be located in the top plate 20 for selectively allowing the passage of air out of the container. In a preferred embodiment, illustrated in FIGS. 2 and 3, the second and third valves 32 and 34 are interconnected by a manifold 36 which is in turn connected through the top plate 20 by a pipe 38. With this arrangement the second valve 32 is thereby located in the top plate 20.

It is also essential to the operation of the present invention that a relief valve means be provided for the bellows type container 24. In the preferred embodiment, illustrated in FIGS. 2 and 3, this may be accomplished by a standpipe 40 which is connected to the second valve 32 and which extends downwardly therefrom below the bottom of the bottom plate 22. The extent to which the standpipe 40 extends below the bottom plate 22 will establish the desired differential pressure to be maintained within the container 24 over the ambient pressure. The standpipe 40 also serves the function of providing pressurized air to the container through the valve 32. This may be accomplished by providing a scuba bottle 42 which may be mounted to the bottom of the bottom plate 22. The scuba bottle 22 has an open and close type valve 44 which may be connected to the standpipe 40 through a scuba regulator 46. Accordingly, when the valve 32 and 44 are open the differential pressure within the container 24 is maintained on a demand basis during its ascent and descent in a manner similar to a diver which would be demanding air through the scuba regulator 46. The preferred embodiment of the invention finally includes a water pump 48 which is connected to the bottom plate 22 for selectively pumping water into the container 24. The pump 48 may be provided with a handle 50 which may be hand operated by the diver for pumping the water into the container. The operational results from this water pump will be fully explained hereinbelow.

Another embodiment of the invention is illustrated at 10*a* in FIG. 4. The embodiment 10a is similar to the embodiment 10 except the valves 32 and 34 are not interconnected by a manifold, and are in turn directly connected into the top plate 20 of the container 24. A pressurized air source at some remote location may be connected to the valve 32 by a hose (not shown) for introducing pressurized air into the bellows type container 24. Further, the embodiment 10*a* is provided with a separate relief valve 52 which may also be connected in the top plate 20. the embodiment 10*b*, illustrated in FIG. 5, is identical to the embodiment 10*a* except the valve 32 is located in the skirt 14 of the container instead of the top plate 20.

OPERATION AND METHOD OF THE INVENTION

The operation and method of the embodiment 10 of the invention is illustrated in FIG. 6*a* through 6*j*. The steps are as follows:

(a) A diver may take the salvage apparatus 10 from the surface craft to the object 12 on the ocean floor in a contracted water filled condition as illustrated in FIG. 6*a*. During this transition the valve 44 on the scuba bottle 42 should be open so that the scuba regulator 46 can pressure compensate itself as well as the length of the standpipe 40 up to valve 32. Valve 32 should be closed so that the container 14 does not fill up with air, and valves 34 and 30 should be left open to avoid squeezing of the bag. After the diver has reached the bottom he may attached the apparatus to the object 12 for lifting or transporting purposes.

(b) After the apparatus is attached to the object 12 valve 34 is closed and valve 32 is opened briefly to inject a small amount of air into the container 24, as illustrated in FIGS. 6*b*. This is a very significant step which results in the small amount of air lifting or buoying up the upper plate 20 so as to separate the two plates 20 and 22. This ultimately results in a stretching of the skirt 14 into a smooth configuration with no folds, as illustrated in FIG. 6*c*. As the top plate 20 is buoyed up water enters the container through the bottom valve 30.

(c) When the bag is fully ballasted by the rising of plate 20 the bottom valve 30 is closed and the top valve 32 is opened so as to allow the scuba regulator 44 to pressurize the skirt 14 into a cylindrical configuration, as illustrated in FIG. 6*d*. Since the regulator 46 is below the top of the salvage apparatus, the interior pressure at the top of the bag will be higher than the ambient pressure at the top of the bag.

(d) When it is desired to deballast the salvage apparatus so as to lift the object 12 valve 30 is opened so that pressurized air through the top valves 32 forces water out of the container through the bottom valve 30 as illustrated in FIG. 6*e*. If the valve 30 is closed while the apparatus and object are still slightly negative, a diver may move the object around to various locations on the ocean floor. If it is desired to lift the object to the surface of the ocean then additional water is discharged from the apparatus through the valve 30 until the apparatus and object are slightly positively buoyant. The object then commences to ascend, as illustrated in FIG. 6*f*. During ascension the expanding air volume in the container is discharged through the top valve 32 downwardly through the standpipe 40 and out the scuba regulator 46, as illustrated in FIG. 6*f*. With this arrangement a constant air volume is maintained within the salvage apparatus so as to cause a constant ascent rate to the surface of the ocean.

(e) If it is desired to decrease the buoyancy of the apparatus and object the diver will operate the pump 48 to pump water into the container 24 thereby driving air out of the container through the top valve 32, thence downwardly through standpipe 40 and out the scuba regulator 46, as illustrated in FIG. 6*g*. If the apparatus and load are made negatively buoyant the combination will commence to descend, as illustrated in FIG. 6*h*. During descend the differential pressure between the inside of the container and ambient will be maintained constant by the scuba regulator 46 so that descend is constant without any change in the air and water volumes.

(f) To remove the salvage apparatus from the object 12 for the purpose of placing the object on the ocean floor the top valve 32 is closed, the valve 34 is opened to let air out of the container, and the valve 30 is opened to let water into the container. As illustrated in FIG. 6i the salvage apparatus will decrease in buoyancy until such time that the apparatus can be disconnected from the object 12.

(g) When salvage apparatus is on the surface of the water, as illustrated in FIG. 6*j*, and is ready to be picked up, valve 34 should be closed, and valve 32 and 30 should be opened until all of the water is blown out of the bag.

Obvously, many other modifications and variations of the present invention are possible in the light of the above teachings. It is therefore to be understood that within the scope of the appended claims the invention may be practiced otherwise than as specifically described.

What is claimed is:

1. A salvage apparatus comprising:

a flexible skirt which has the shape of a cylindrical tube with top and bottom ends;

a pair of rigid circular plates, one of the plates being sealably mounted to the top end of the skirt and the other plate being sealably mounted to the bottom end of the skirt so that a bellows type container is formed;

the lateral area of each plate substantially encompassing the lateral expanded area of the respective skirt end;

first valve means being located in the bottom plate for selectively allowing the passage of water into or out of the container;

second valve means being located in the top plate for selectively introducing pressurized air into the container;

relief valve means being located through the container for relieving air from the container when the inside and outside differential pressure has exceeded a predetermined level, the relief valve means including a standpipe which is connected to the second valve means and which extends downwardly therefrom;

a scuba regulator connected to the bottom of the standpipe;

a pressurized air bottle mounted to the bottom of the bottom plate; and the scuba regulator being connected to the pressurized air bottle;

a water pump connected to the bottom plate for selectively pumping water into the container; and third valve means located in the top plate for selectively allowing the passage of air out of the container.

2. A salvage apparatus as claimed in claim 1 including:

the second and third valve means being combined by a manifold.

3. A method of handling a submerged object with a bellows type container which has top and bottom plates encompassing a flexible skirt therebetween, the top plate having a relief valve and the bottom plate having a valve for opening and closing the passage of water comprising the steps of:

descending the container in water to the object;

attaching the container to the object;

introducing air into the container until the top plate is buoyed up, and opening the valve in the bottom plate so that as the top plate is buoyed up water is drawn into the container to expand the skirt;

introducing additional air into the container with the valve in the bottom plate open until the container is sufficiently deballasted that the object can be moved; and closing the valve in the bottom plate.

4. A method as claimed in claim 3 for decreasing buoyancy of the container and the attached object comprising the steps of: introducing pressurized water into the container and simultaneously venting air through the relief valve until the desired decreased in buoyancy is attained.

5. A method as claimed in claim 4 for decreasing buoyancy of the container and the attached object, the top plate of the container having a valve for opening and closing the passage of air, the method comprising the steps of:

opening the valves in the top and bottom plates so that air is vented through the top plate and water is simultaneously drawn in through the bottom plate; and closing the valves when the desired decrease in buoyancy is attained.

6. A salvage apparatus comprising:

a flexible skirt which is generally tubular with top and bottom ends;

a pair of rigid plates, one of the plates being sealably mounted to the top end of the skirt and the other plate being sealably mounted to the bottom end of the skirt so that a bellows type container is formed;

the lateral area of each plate substantially encompassing the lateral expanded area of the respective skirt end;

first valve means being located in the bottom plate for selectively allowing the passage of water into or out of the container;

second valve means being located in the top plate for selectively introducing pressurized air into the container;

relief valve means being located through the container for relieving air from the container when the inside and outside differential pressure has exceeded a predetermined level, the relief valve means including a standpipe which is connected to the second valve means and which extends downwardly therefrom;

a scuba regulator connected to the bottom of the standpipe;

a pressurized air bottle mounted to the bottom of the bottom plate; and the scuba regulator being connected to the pressurized air bottle.

* * * * *